United States Patent [19]

Boysen et al.

[11] Patent Number: 4,513,181

[45] Date of Patent: Apr. 23, 1985

[54] COMBINATION MECHANICAL AND ELECTRICAL INTERLOCK MECHANISM

[75] Inventors: Gerd C. Boysen, Greenfield; Patrick S. Murray, Racine; Marquis B. Robinson, Wauwatosa, all of Wis.

[73] Assignee: Allen-Bradley Company, Milwaukee, Wis.

[21] Appl. No.: 581,742

[22] Filed: Jan. 23, 1984

[51] Int. Cl.[3] ..... H01H 9/20

[52] U.S. Cl. ..... 200/50 C; 335/160

[58] Field of Search ..... 200/5 R, 5 B, 18, 50 C, 200/50 R; 335/132, 160, 192

[56] References Cited

U.S. PATENT DOCUMENTS

| | | | |
|---|---|---|---|
| 965,671 | 7/1910 | Whittingham | 318/258 |
| 1,037,580 | 9/1912 | Bechoff | 200/5 B |
| 1,732,711 | 10/1929 | Boddie | 318/261 |
| 2,186,670 | 1/1940 | Fereday | 335/160 |
| 2,262,071 | 11/1941 | Van Valkenburg | 200/50 R |
| 2,349,616 | 5/1944 | Ellis et al. | 200/5 R |
| 2,359,614 | 10/1944 | Brooks | 200/50 C X |
| 2,398,656 | 4/1946 | McFarland, Jr. | 200/50 C |
| 3,149,210 | 9/1964 | Haydu et al. | 200/50 C |
| 3,160,793 | 5/1962 | Colburn et al. | 361/192 |
| 3,210,491 | 10/1965 | Di Marco | 200/50 C |
| 3,240,889 | 3/1966 | Lawrence et al. | 335/160 |
| 3,437,773 | 8/1969 | Koertge | 200/243 |
| 3,510,612 | 5/1970 | Ward | 200/50 C |
| 3,536,868 | 10/1970 | Lawrence et al. | 200/50 R |
| 3,564,466 | 2/1971 | Lawrence et al. | 335/132 |

FOREIGN PATENT DOCUMENTS

| | | |
|---|---|---|
| 1340955 | 10/1963 | France . |
| 2164486 | 8/1973 | France . |
| 2525025 | 8/1983 | France . |
| 2077042A | 12/1981 | United Kingdom . |

*Primary Examiner*—J. R. Scott

*Attorney, Agent, or Firm*—Arnold J. Ericsen

[57] ABSTRACT

A combined electrical and mechanical interlock for electrical circuit controllers. Auxiliary electrical interlocking contacts are simultaneously operated by the mechanical interlocking operators, and auxiliary interlock contact assemblies. The mechanical and electrical interlock operators are all preferably contained within a common enclosure.

9 Claims, 5 Drawing Figures

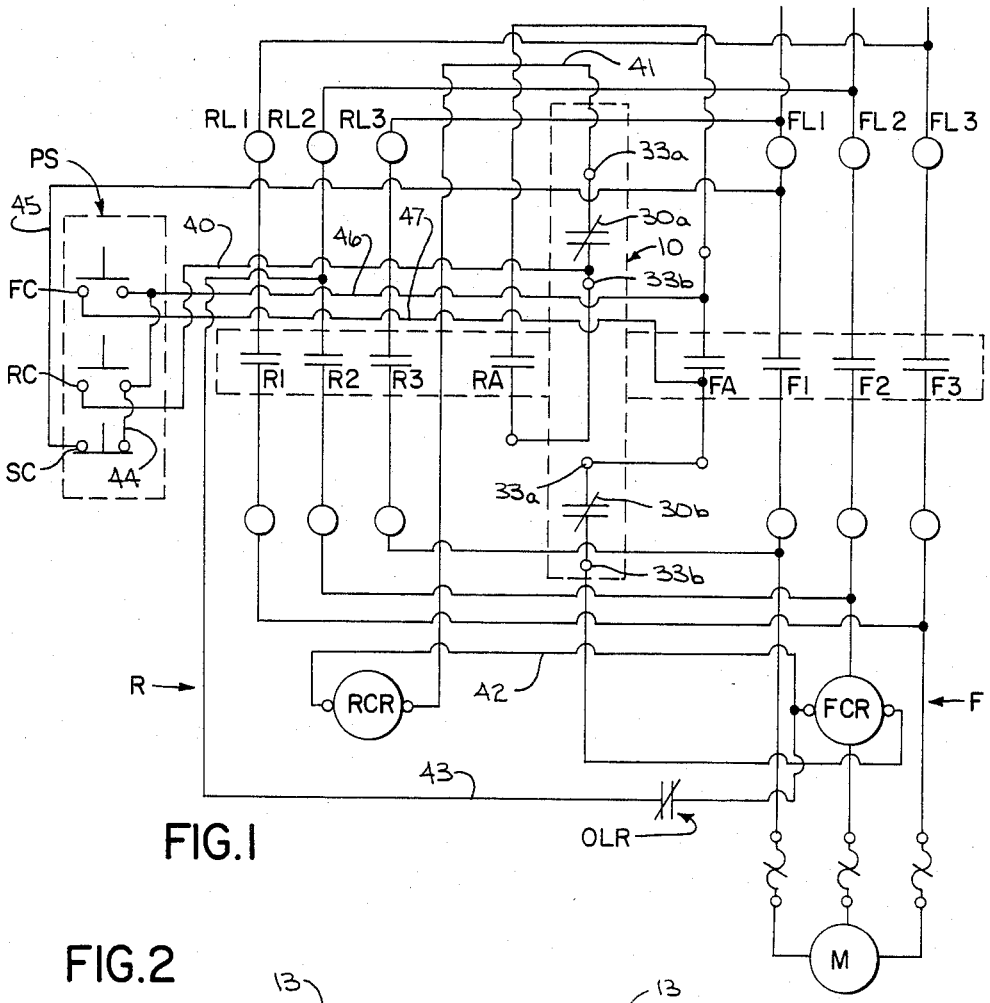
FIG.1
FIG.2
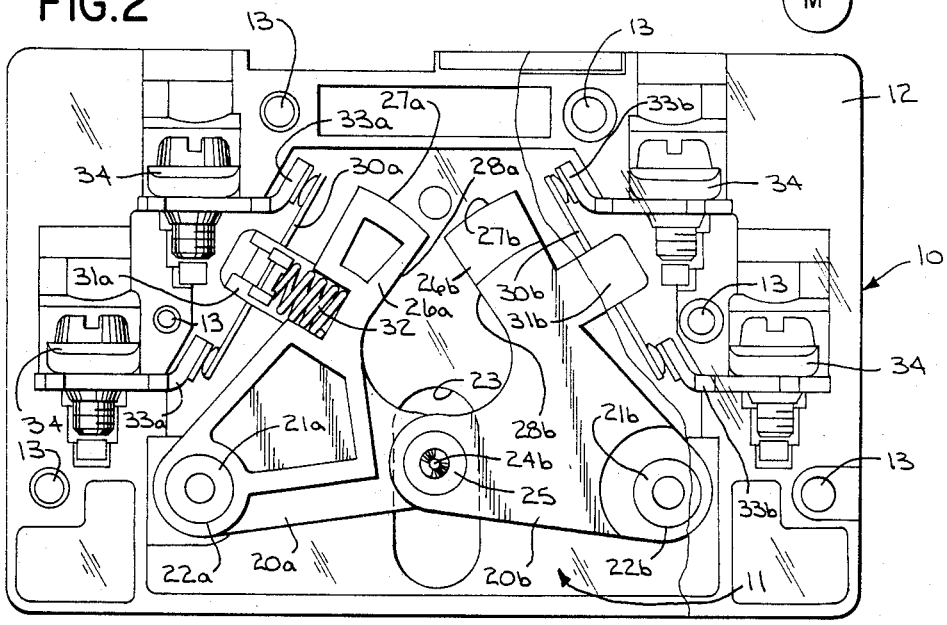

COMBINATION MECHANICAL AND ELECTRICAL INTERLOCK MECHANISM

FIELD OF THE INVENTION

The present invention relates to electric circuit controllers, and particularly to a combination electrical and mechanical interlock mechanism for preventing the closure of one motor starter contactor when a second contactor is closed and for preventing closure of the second contactor when the first contactor is closed.

BACKGROUND ART

In many applications it is necessary to provide two motor starters or contactors connected to energize the same electrical device from the same energy source. A typical application of this type may be found in a polyphase reversible motor.

There are known individual mechanical and electrical interlocking arrangements for avoiding simultaneous closure of both contactors. It is also known to provide starter circuits wherein components permit both electrically and mechanically interlocking. In general, mechanical interlocking devices may take the form of those shown in U.S. Pat. Nos. 3,240,889, 3,536,868 or 3,564,466, each of which are assigned to the assignee of the present invention. Devices for preventing the simultaneous closure of two or more control circuits have been known since the advent of the 1912 Bechoff U.S. Pat. No. 1,037,580. This concept has evolved into self-contained mechanical interlock assemblies, such as those disclosed in U.S. Pat. No. 3,510,612 granted to Ward, and in U.S. Pat. No. 3,210,491 granted to DiMarco. In both of the latter-mentioned assemblies, there is an provided arrangement for seating the self-contained unit between adjacent contactors.

In situations where both electrical and mechanical interlocking is deemed to be beneficial or necessary, as in the case of requirements in certain industry standards, wherein electrical interlocking requires separate auxiliary contacts individually attached to the contactors, occupying considerable space with extra wiring for connection of these auxiliary switches with the various terminals of the individual contactors.

From a practical and commercial standpoint, it is obvious that reduction in size of electrical control devices is a user convenience and often a requirement. Reversing motor starters are often contained within modular control centers where the user-customer expects such centers to be of a size suitable for locating a maximum number of control devices, wiring and adjunct equipment within a minimum amount of space.

BRIEF SUMMARY OF THE INVENTION

The present invention provides a unitary, self-contained interlock mechanism of simplified construction, comprising a container of minimal width requiring minimal spacing between adjacent circuit controllers, in addition to the elimination of separate auxiliary contact devices heretofore required for electrical interlocking purposes. The combination electrical and mechanical interlock mechanism includes, in its preferred construction, not only pivotally mounted operators individually defining a physical blocking formation for preventing simultaneous operation of movable members of the respective contactors, but further confines the electrical interlock contacts entirely within the container housing to be operated concurrently with the mechanical operators. The electrical interlock contacts are preferably mounted on each of the respective operators in a manner which permits a movable contact member to move from a normally closed contact position in an electrical interlocking circuit to an alternative open contact position concurrently with the closure of a movable holding contact in conjunction with the actuation of a movable element located on a reversing motor starter contactor.

It is, therefore, an object of the present invention to provide a combination electrical and mechanical interlock mechanism for a pair of circuit controllers, wherein the mechanism is responsive to movement of certain individual controller elements that normally move in the same direction, and which mechanism further accomplishes its interlocking function by means of a pair of mechanical interlocking operators, each having an integral blocking formation to physically prevent the controllers from being closed simultaneously. The interlock mechanism is housed in a self-contained, relatively thin, unit preferably disposed between the controllers, and which unit also contains a first and a second movable bridging contact, each bridging contact respectively operated in conjunction with the operation of the mechanical interlocking operators from a first normally closed circuit position with respect to a pair of stationary interlocking contact members. Initial closure of an interlocking electrical circuit is thereby accomplished in conjunction with normally open power pole contacts respectively operated by a movable element on a respective one of said controllers to prevent simultaneous closure mechanical closure of a similar element of the other controller.

Another object of the present invention is to provide an interlock mechanism including a relatively thin, self-contained enclosure adapted to be positioned between two adjacent circuit controllers, and which mechanism incorporates mechanical interlocking operators arranged to individually actuate the movable contact of an electrical interlock circuit auxiliary contact also contained within the said enclosure, and with this object in mind, to make available room on each controller for auxiliary devices which were formally mounted apart from the respective controllers.

A further object of the present invention is to provide a self-contained unitary interlock mechanism containing pivotally supported, interlocking mechanical operators having respective blocking formations to prevent simultaneous actuation of respective circuit controllers and which operators include means for engaging elements on the respective circuit controllers movable in the same direction, and which interlock mechanism further includes electrical interlocking contact assemblies within the self-contained unit, each interlocking contact assembly having respective movable bridging contact members supported by a respective operator and alternatively movable from a normally closed circuit position to a normally open position depending upon the operation of a particular one of a pair of circuit controllers operating in conjunction therewith.

Still another object of this invention is to provide a combination electrical and mechanical interlock mechanism for a pair of circuit controllers, having in addition to a pair of alternatively movable mechanical interlocking operators a pair of normally closed electrical interlocking contact assemblies respectively operated concurrently with the mechanical operation of respective mechanical interlocking operator and a second pair of normally open electrical holding circuit contact assemblies also operated concurrently with alternative actuation of said mechanical and electrical interlocking operators and contact assemblies, and to locate said mechanical operators and said pairs of contact assemblies in a self-contained unitary enclosure, to thereby conserve space normally required by separate, contact assemblies located apart from said mechanical interlocking operators.

BRIEF DESCRIPTION OF THE DRAWINGS

FIG. 1 is a schematic diagram illustrating a typical wiring circuit for a pair of electrically interlocked circuit controllers, such as reversing motor starters, and wherein certain portions of the circuit illustrate the location of auxiliary electrically interlocking contact assemblies a pair of which are contained within a unitary, self-contained structure along with mechanical interlock operators in accordance with the present invention.

FIG. 2 is a longitudinal view of the mechanism a first embodiment of the present invention preferably housed in a transparent enclosure, and illustrating the initial operating position of the operating elements of the combined electrical circuit interlocking contacts operated by respective mechanical interlocking operators for motor starters contactors and wired in accordance with the diagram of FIG. 1.

DETAILED DESCRIPTION OF THE PREFERRED EMBODIMENT

Figure 3:
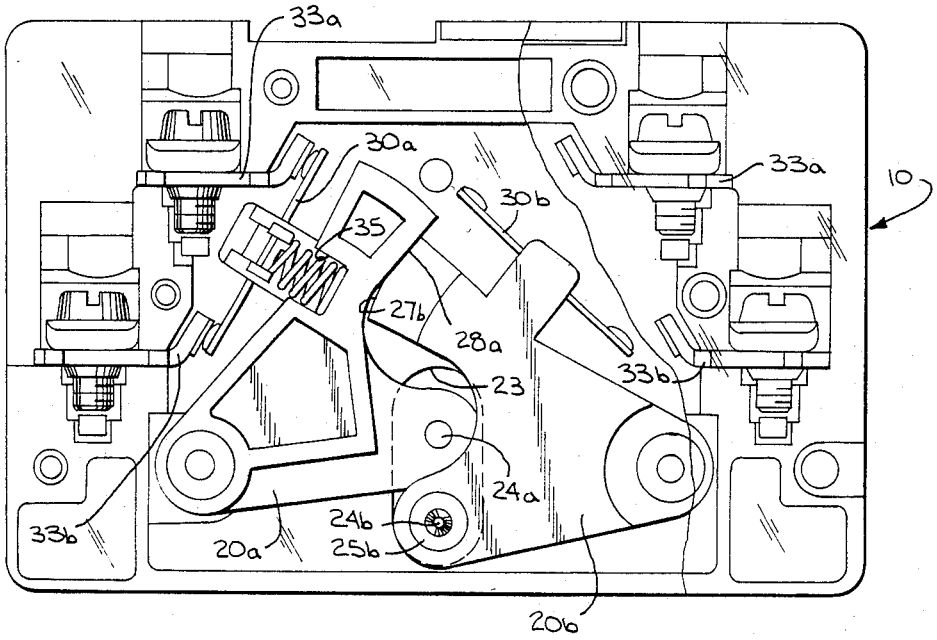
FIG. 3 is the same view as FIG. 2, but with the elements shown in their respective second, alternative operating position.

With reference to the drawings, it will be observed that the interlock mechanism 10 (also indicated in phantom outline in FIG. 1) of the present invention includes its operating components confined within the chamber or cavity 11 of a two-part, preferably transparent, housing or enclosure 12. As will be noted, interlock mechanism 10 provides a relatively thin, self-contained unit capable of being mounted between adjacent motor starter contactors (not specifically shown). Typical controllers are described and claimed in U.S. Pat. No. 3,962,658 assigned to the assignee of the present invention. The reversing motor starter assembly, combined with an interlock mechanism, is preferably arranged in a manner quite similar to that disclosed in the DiMarco U.S. Pat. No. 3,210,491.

Reversing, electromagnetically operated circuit controllers, or motor starter contactors, are illustrated symbolically in the view of FIG. 1, and identified generally by reference characters R (reversing) and F (forward), respectively, and are operated by control coils RCR and FCR. The motor reversing control contactor R, by means of its coil RCR, operates appropriate, normally open, power pole contacts R1, R2 and R3, respectively and the forward motor control coil FCR of contactor F actuates normally open power poles F1, F2 and F3, respectively. Both control coils RCR and FCR may be energized by means of a manually operated, momentary pushbutton station PS with appropriately identified normally open contacts FC and RC for forward and reverse motor operation and normally closed contact SC, which provides means for stopping the motor M.

Figure 4:
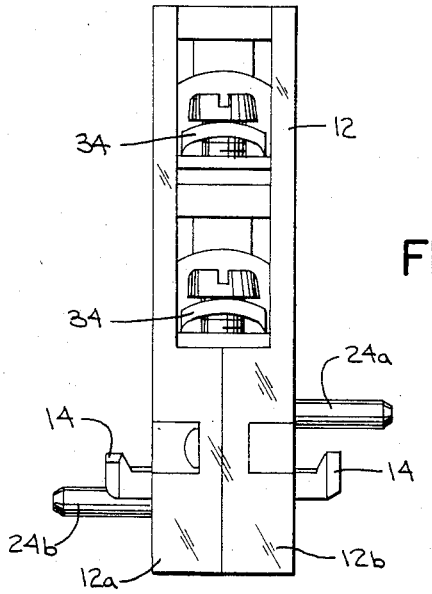
FIG. 4 is an end view taken from the right side of the views of FIGS. 2 and 3 of the interlocking mechanism.

With reference to FIGS. 2, 3 and 4, the housing 12 of the mechanism 10 comprises identically formed, mating sections **12*a* and 12*b*, both preferably molded of transparent, plastic insulating material. The mating sections 12*a* and 12*b* are joined together to provide an enclosed construction by conventional means, such as heat staking, riveting or other well-known attaching means. In the present device, the sections or halves 12*a* and 12*b* are heat staked at the areas indicated by the reference numeral 13. As previously stated, the sections 12*a*, 12*b* are preferably identical for ease in assembly and manufacture, as well as minimal cost considerations. The sections 12*a*, 12*b* are preferably molded from transparent material in order to provide a convenient means for orienting internally located components during assembly of the mechanism 10 and also for convenience in locating the mechanism between adjacent contactors (not shown). As shown in FIG. 3, the component parts of the interlock mechanism 10 have been actuated to motor reversing position. Operation will be explained later in connection with FIG. 1**.

It will become apparent from later explanation that a particular mechanical operator will be actuated by a particular moving element of a selected contactor F or R. It is imperative that each of the electrical interlocking elements operate concurrently with alternative movement of its respective mechanical interlocking operator, and that this concurrent operation must be assured during initial mounting of the interlock mechanism between adjacent motor starter contactors to achieve the deserved interlocking function for correct and safe directional movement of the motor M. Visual observation of the relative operating position of the contacts and of the operators during assembly of the mechanism with respect to the contactors R and F provides this assurance.

Projecting from opposite sides of the housing 12, and integrally molded therewith, are mounting elements 14. The elements 14 are not considered to be part of the present invention, but are provided for lateral support with cooperating elements of a particular circuit controller design (not shown).

As stated previously, the present interlock mechanism finds ultimate cost advantage and simplicity of inventory and manufacturing tooling, fixturing and assembly by providing its various components as identically configured parts. For instance, as aforestated, the housing sections **12*a* and 12*b* are identical, and are arranged to define the chamber, or cavity 11 in which there is disposed identically formed operators 20*a* and 20*b*, pivotally supported at 21*a* and 21*b* by means of laterally extending pivot projections 22*a* and 22*b*. The sidewalls of respective housing sections 12*a* and 12*b* are each provided with elongated openings 23 for permitting unobstructive movement of laterally projecting operating handles in the form of steel pins 24*a* and 24*b*, press fit into an opening in the embossed area 25 of the respective operators 20*a* and 20*b***.

It will be further observed that the operators **20*a* and 20*b* are respectively provided with cooperating blocking formations comprising integrally formed projections 26*a* and 26*b* each respectively defining blocking cam surfaces 27***a*, 27*b* and 28*a*, 28*b*. The external cam surface 27*b* and 28*a* of the operators 20*b* and 20*a* are shown in FIG. 3 in blocking formation, simultaneously with the operation of a reversing contactor R (See FIG. 1) to circuit closed position by means of its control coil RCR responsive to momentary manual closure of pushbutton contact RC. The normally open pole line contacts R1, R2, R3 will have been mechanically moved to their respective closed position by conventional electromagnetic operation of the relay RCR to complete the current to start the motor M in its reverse direction. This operation will be described later in detail. For the present purposes, it may be stated that the handle 24*b*, projecting from the reversing operator 20*b*, will be in the down position as shown in FIG. 3, having been moved downwardly from the normal operating position shown in the view of FIG. 2 by an operating element (not shown) on the reversing starter contactor R.

It will be further observed from the views of FIGS. 2 and 3 that the present invention provides a novel combination of electrical interlock contact assemblies operated conjointly with the mechanical operating members 20*a* and 20*b*. It is preferable to mount the spanner or bridging movable contact members 30*a* and 30*b* of each interlock contact assembly directly on, or supported by, a respective operator 20*a* and 20*b*. The essence of novelty in this arrangement provides minimal space requirements in the assembly of adjacent reversing contactors or electrical controllers, with both the operator and the contacts housed together in a self-contained unit.

The identically formed bridging contact spanners 30*a* and 30*b* are slidably retained within the confines of an L-shaped, integrally formed contact retainer portions 31*a*, 31*b* of the respective operators 20*a* and 20*b*. A biasing spring 32 provides a means of biasing a respective spanner 30*a*, 30*b* towards circuit closed position relative to its stationary contact pairs 33*a* or 33*b*. The respective ones of each of the stationary contact pairs 33*a* and 33*b* are preferably identical in configuration, and each are provided with threaded openings for receiving identical terminal screw assemblies 34. It will be apparent that other means of termination, such as by means of stab type terminals may be provided when required by a customer-user.

Referring again to the views of FIGS. 2 and 3, it will be noted that FIG. 2 depicts the operating components of the interlock mechanism 10 in the normal or initial operating position with both of the interlock contact spanners 30*a*, 30*b* in circuit closed position with respect to stationary contact pairs 33*a* and 33*b*. This should also be considered with reference to FIG. 1, in the normal operating position with the motor M stopped, contactors or controllers R and F have their respective motor power poles R1, R2, R3 and F1, F2, F3 in normal circuit open position. The three-phase motor M is electrically connected to these respective power poles. The pushbutton contact assemblies FC and RC are shown in their normally open, manual operating position with the start button contact SC in normally closed position. Thus, responsive to momentary manual operation of reversing pushbutton contact RC, line current will be supplied from terminals RL1, RL2, RL3 to the power poles R1, R2, R3 to complete the circuit from contact RC through conductor 40 through the stationary auxiliary contact terminals 33*a*, via normally closed contact spanner 30*a*, through conductor 41, through the coil of the control relay RCR of reversing contactor R, the conductor 42, via the normally closed overload relay contact OLR, conductor 43 to the terminal of incoming line RL2. The circuit is then completed at the other side of manually closed contact RC, via normally closed contact SC of the stop button, the conductors 44 and 45 to incoming line terminal FL1. The normally open holding contact assembly RA will be closed concurrently with closure of power pole contacts R1, R2 and R3. When closed, holding contact RA will act as a circuit holding contact upon manual release of momentary pushbutton contact RC, to thereby maintain the circuit through the control coil RCR of reversing starter R until such time as the normally closed stop button contact SC is depressed to de-energize the circuit of FIG. 1.

Thus, upon completion of the motor reversing circuit, as just described, the mechanical interlock operators 20*a* and 20*b* will be pivotally moved by means of handle 24*b* engaging a moving element (not shown) on the contactor R to the position shown in FIG. 3 and simultaneously with energization of the reversing control coil RCR. Movement of reversing operator 20*b* to the position shown in FIG. 3 will cause the bridging spanner contact 30*a* to remain in closed position with respect to stationary contacts 33*a* as the forward mechanical operator 20*a* will be blocked from movement by interference of the cam surface 27*b*, underlying the concave surface 28*a* of operator 20*a*. Again, with reference to the views of FIGS. 1 and 3, it will be noted that the normally closed reversing contact spanner 30*b* will have been moved away simultaneously with counterclockwise pivotal movement of reversing operator 20*b*, from circuit connection with its respective stationary terminal contacts 33*b*. This action will also provide concurrent electrical interlocking means for preventing closure of the second motor contactor F which controls forward movement of the motor M. Electric power will be prevented from entering the control relay FCR when the spanner 30*b* has been moved to circuit open position of FIG. 3. It may be noted that the contact spanner 30*a* is additionally biased towards its closed position by means of the compression spring 32 seated in the well 35 of the portion 31*a* of the operator 20*a*.

It will be apparent from the circuit diagram of FIG. 1 that the motor may be stopped and later restarted in a forward direction upon momentary manual operation of the pushbutton contacts SC which opens the circuit through conductors 44 and 45, and thereby permit the control coil RCR to open its pole line contacts R1, R2, R3 and holding contact RA.

Operation of the motor in the forward direction is accomplished in similar manner as that of reverse operation. In this mode, upon momentary manual closure of contact FC, the forward contactor coil FCR will be energized via conductors 44, normally closed contact SC of pushbutton PS, conductor 45 to power line terminal FL1 on one side of the line, and via conductors 46 and 47, the interlock contact 30*b*, normally bridging its stationary contacts 33*b*, the normally closed contact on overload coil relay contact OLR and conductor 43 to power line terminal RL2 on the return side.

Figure 5:
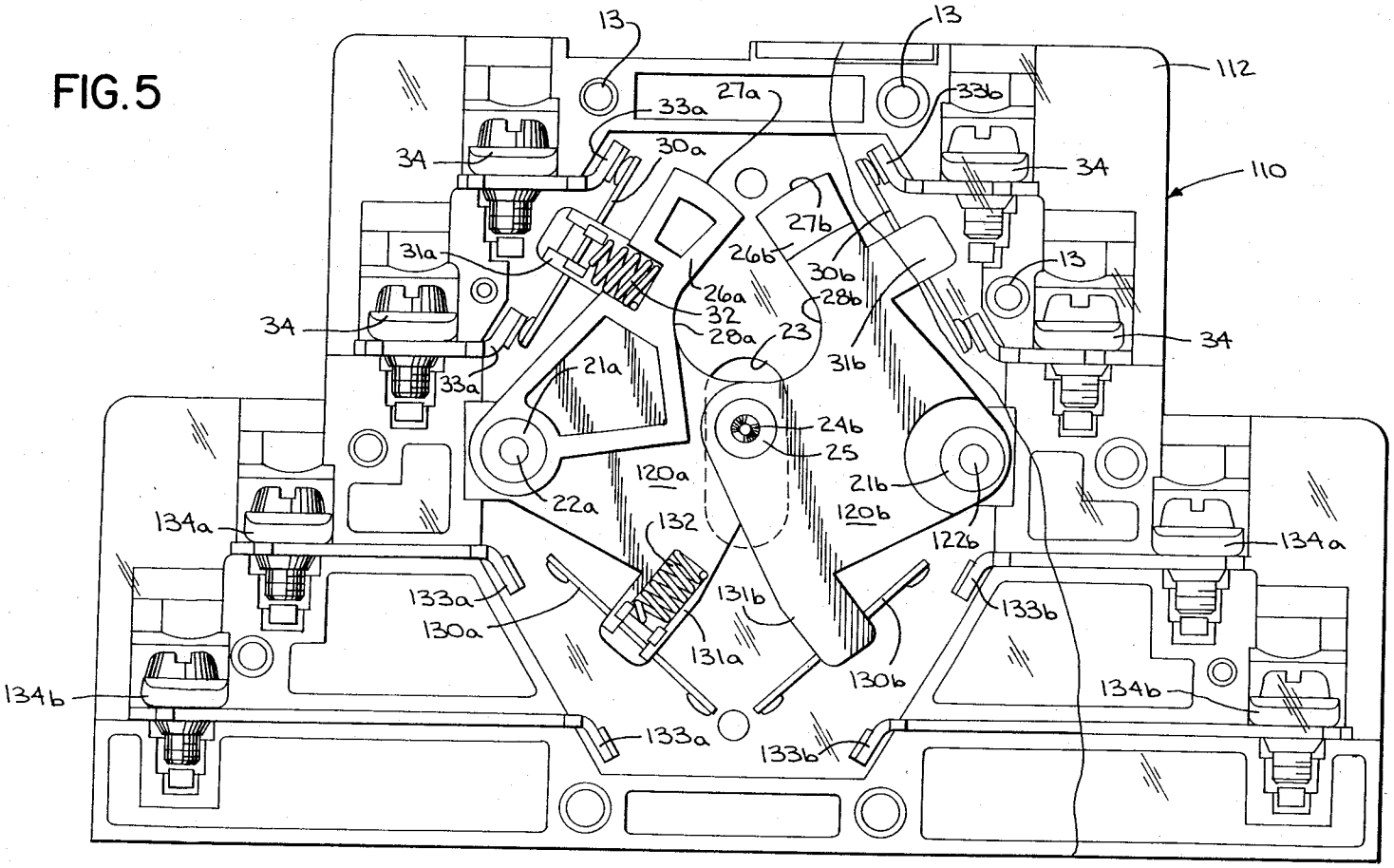
FIG. 5 is a view similar to the view of FIG. 2, illustrating another embodiment, wherein the respective circuit holding contact assemblies of respective circuit controllers are also contained within a unitary housing along with the mechanical and electrical interlocking elements of the comination interlock mechanism of this invention.

Another embodiment of the present invention will next be discussed in connection with the illustration of FIG. 5. It will be noted, for ease in discussion, that all like elements of the versions of FIG. 5 and of the previously discussed version of FIGS. 2–4, will be referred to by like reference characters.

The unitary construction of the present embodiment operates in the same manner as previously described in connection with the embodiment of FIGS. 2–4, inclusive. That is, a set of normally closed electrical interlocking contact assemblies comprising the movable bridging contacts 30*a* and 30*b* are also normally closed as shown in the view of FIG. 5 to complete the circuit through stationary contacts 33*a* and 33*b*, respectively. This initial position was also discussed in connection with the view of FIG. 2. Also, the components comprising the terminals 34 are preferably identically formed, as are the spanners 30*a* and 30*b* and respective stationary contacts 33*a* and 33*b*.

The present embodiment, with reference to FIG. 1, features removal of the normally open holding contacts RA and RF from the position shown in the FIG. 1 circuit drawing to be included within the area defined by the phantom outline 10. The embodiment of the invention, as shown in FIG. 5, provides for the addition of normally open holding contact assemblies 130*a*, 133*a* and 130*b*, 133*b* within the confines of the housing 112. Each of the respective terminal connections 34, and 134*a*, 134*b* are offset laterally relative to its respective adjacent upper contact set to permit insertion of conventional screwdrivers for completing termination to electrical connections (not shown). The present embodiment provides for terminations 134*a* and 134*b* which have several components identical in nature, such as the terminal screws, pads and the like, but the stationary contact portions 133*a* and 133*b* have been elongated when compared to 33*a* and 33*b*, and 134*b* is of a longer construction than 134*a* to permit the aforementioned offset construction for unincumbered reception of screwdrivers, Allen wrenches or other fastening tools.

In the present construction, it will be noted that the operators 120*a* and 120*b* are substantially identical in their camming and blocking arrangements and portions interacting with one another, as previously described embodiments of FIGS. 2 and 3. In the present version the operators 120*a* and 120*b*, have been modified at there respective lower portions to include integrally formed portions 131*a* and 131*b*, each extending downwardly relative to the view of FIG. 5, the portions 131*a* and 131*b* provide means for slidably retaining movable spanners or contacts 130*a* and 130*b*, respectively. These spanners 130*a*, 130*b* are identical with the spanners 30*a* and 30*b* and are retained in the same manner by the integrally formed portions 131*a* and 131*b* as previously described in connection with integrally formed operator portions 31*a* and 31*b*. A biasing spring 132 normally biases the respective spanner 130*a*, 130*b* towards closed position with respect to its stationary contacts 133*a*, 133*b*. It will be noted that this contact assembly comprising the contacts 130*a*, 133*a* and 130*b*, 133*b* are normally open as shown, and are the physical embodiment of holding contacts RA and RB of FIG. 1, respectively.

Thus, it will be observed that an additional set of auxiliary contacts may be contained within the unitary housing 112. Again, the housing 112 is preferably comprised of two mating halves, as in the case of the housing 12 for economics in construction and ease in assembly. The mating members comprising the housing are also preferably transparent as above described in connection with the housing 12.

It will be obvious that the disposition of the normally closed, interlocking contact assemblies, respectively comprised of the elements 30*a*, 33*a* and 30*b*, 33*b* and the normally holding contact assemblies 30*a*, 133*a* and 130*b*, 133*b*, eliminate the need for separate auxiliary units, to thereby provide considerable additional space on the individual circuit controllers or motor starter contactors for mounting of additional auxiliary contacts for indicator lights, closing or opening ancillary circuit connections, or for any other purposes normally accomplised by auxiliary contact constructions intended to be moved concurrently with movable elements on respective motor starter contactors.

We claim:

1. In an interlock mechanism for a pair of circuit controllers each having normally open contact assemblies concurrently operable with a respective circuit controller, said mechanism responsive to movement of individual controller elements movable in the same direction, said mechanism comprising a stationary support member, first and second movable operators supported by said support members, each of said operators including means for respectively engaging one of said individual controller elements, each of said operators including a blocking formation, said operators being independently movable from a first position to a second position, said operators positioned so that predetermined movement of either operator partway from its first position toward its second position places the blocking formation of this operator in the path of movement of the blocking formation of the other of said operators so that the latter is prevented from moving to its second position; the combination therewith of first and second electrical interlock contact assemblies, each electrical contact assembly respectively including a first and a second pair of stationary contacts and a first and second movable bridging contact, said bridging contacts each respectively operated by the said first and second operators from a first normally closed contact position to a second contact open position concurrently with contact closure of the auxiliary contact assembly of a respective one of said pair of circuit controllers, and biasing means urging each of the movable contacts of said interlock contact assemblies towards contact closed position.

2. The interlock mechanism of claim 1, wherein said stationary support member comprises a relatively thin enclosure of transparent insulating material having internal formations cooperating to define a chamber for receiving and supporting said movable operators and the respective interlock contact assemblies and said normally open contact assembly.

3. The interlock mechanism of claim 1, wherein the movable bridging contacts of the interlock contact assemblies are respectively supported by and movable conjointly with said movable operators from said first normally closed position to said second contact open position dependent upon selective alternative movement of its respective operator.

4. The interlock mechanism of claim 3, wherein the said movable operators are pivotally supported by said stationary support member.

5. The interlock mechanism of claim 4, wherein said stationary support member comprises a relatively thin enclosure of transparent material having internal formations cooperating to define a chamber for receiving and supporting the respective interlock contact assemblies.

6. The interlock mechanism of claim 2, wherein said transparent enclosure is comprised of a pair of identical mating sections, the first and second electrical interlock contact assemblies are each composed of identically formed, interchangeable stationary and movable contacts, and wherein said first and second operators are each identical and interchangeable with one another.

7. The interlock mechanism of claim 1, wherein the said normally open contact assemblies each include a pair of stationary contacts and a movable bridging contact, and wherein each of the movable contacts of each of said pairs of normally open contact assemblies is operated by and concurrently movable with a respective one of said movable operators towards circuit closed position with respect to its pair of stationary contacts.

8. The interlock mechanism of claim 7, wherein the bridging contact of each of said normally open contact assemblies is supported by and and concurrently movable with a respective operator.

9. The interlock mechanism of claim 8, wherein said stationary support member comprises a relatively thin enclosure of transparent insulating material having internal formations cooperating to define a chamber for receiving and supporting each of said movable operators, each of said respective interlock contact assemblies and each of said normally open contact assemblies.

* * * * *